United States Patent [19]

Yamagishi et al.

[11] 4,309,959

[45] Jan. 12, 1982

[54] APPARATUS FOR APPLYING CHEMICAL PLATING TO INNER SURFACES OF TUBULAR MEMBERS

[75] Inventors: Ryozo Yamagishi; Mamoru Mita; Osamu Yoshioka; Tetsuo Ishikawa, all of Hitachi, Japan

[73] Assignee: Hitachi, Ltd., Tokyo, Japan

[21] Appl. No.: 152,298

[22] Filed: May 22, 1980

[30] Foreign Application Priority Data

May 29, 1979 [JP] Japan ..... 54/66610

[51] Int. Cl.[3] ..... B05C 7/04

[52] U.S. Cl. ..... 118/664; 118/408; 118/503; 118/DIG. 10

[58] Field of Search ..... 118/664, 408, 421, 429, 118/DIG. 10, 503, 667; 134/166 C, 168 C, 169 C, 171

[56] References Cited

U.S. PATENT DOCUMENTS

| | | | |
|---|---|---|---|
| 1,194,542 | 8/1916 | Raymond | 134/169 C |
| 1,354,418 | 9/1920 | Pershing | 118/503 |
| 2,222,676 | 11/1940 | Mahler | 134/171 |
| 2,888,374 | 5/1959 | Heinenberg | 134/169 C X |
| 3,934,054 | 1/1976 | Schmeling et al. | 118/421 X |

FOREIGN PATENT DOCUMENTS 54-45495 4/1979 Japan .

*Primary Examiner*—John P. McIntosh
*Attorney, Agent, or Firm*—Craig and Antonelli

[57] ABSTRACT

Apparatus for applying chemical plating to inner surfaces of tubular members including a tank for storing a plating solution, a table for supporting a plurality of tubular members to be simultaneously plated, a plating solution distributing member connected to the storage tank via a plating solution supply line mounting a pump, and a plating solution collecting member connected to the storage tank via a plating solution return line. To provide a liquidtight seal, each tubular member to be plated is connected at its plating solution inlet end to the distributing member through a first connector and at its plating solution outlet end to the collecting member through a second connector. Each tubular member supported on the table, which is suitably inclined to allow hydrogen gas to be released through the plating solution outlet end of each tubular member to be plated, is encased in a supporting member formed of insulating material and comprising detachably attached two halves. The plating solution distributing and collecting members are similar in shape, the former having an inverted T-shape and the latter a T-shape. The storage tank is connected to a heater to keep constant the temperature of the plating solution and has a monitoring sample inserted therein to indicate the thickness of the coating.

13 Claims, 6 Drawing Figures

APPARATUS FOR APPLYING CHEMICAL PLATING TO INNER SURFACES OF TUBULAR MEMBERS

BACKGROUND OF THE INVENTION

This invention relates to apparatus for plating inner surfaces of tubular members which is suitable for use in applying chemical plating to the inner surfaces of the tubular members.

An example of the prior art for applying chemical plating to inner surfaces of tubular members, Japanese patent application laid-open No. 45495/79 (corresponding to U.S. Ser. No. 820,797) discloses the art of applying copper plating to zirconium tubes. The problems encountered in applying chemical plating according to the prior art to the inner surfaces of the tubular members could be summarized as follows:

(1) When a chemical plating method is adopted, deposition of the metal to the surface of the plated member takes place more slowly than when an electro plating method is used. Thus, when the large number of tubular members to be individually treated, the plating operation would be necessary long time.

(2) As a chemical plating operation is carried out over a prolonged period of time, a rotor and shaft of a plating solution circulating pump undergo deposition of metal by reducing reaction, and these parts would be subjected to a high friction during rotation. When this phenomenon occurs, it would be necessary to stop the pump after a continuous operation is performed for about 5 or 6 hours.

The pump thus stopped must be overhauled and its parts must be cleaned. When copper plating is applied, cleaning of the parts must be polished with concentrated nitric acid. When plating is applied simultaneously to the inner surfaces of a plurality of tubular members, and the number of pumps used is equal to the number of tubular members to be treated, a lot of labor would be required for performing a pump cleaning operation and the plating operation efficiency is applied would be greatly reduced. Moreover, this might cause variations in the quality of the coating applied to tubular member and in the thickness of the coating.

SUMMARY OF THE INVENTION

This invention has as its object the provision of apparatus for plating inner surfaces of tubular members which enables application of chemical plating to inner surfaces of a large number of tubular members to be effected with a high efficiency, which allows maintenance and administration to be effected readily, and which permits variations in the quality of coating applied to the tubular members to be minimized.

DESCRIPTION OF THE PREFERRED EMBODIMENT

Figure 1:
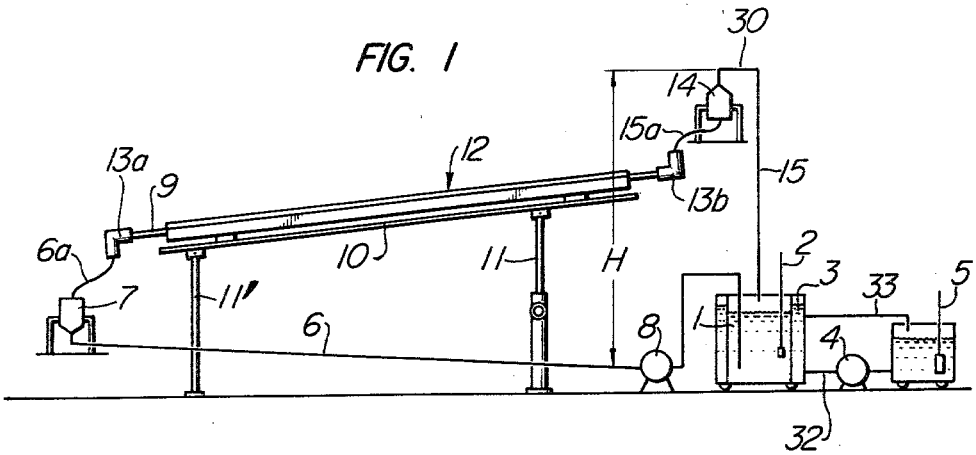
FIG. 1 is a front view of the apparatus for chemical plating inner surfaces of tubular members comprising one embodiment of the invention.
Figure 2:
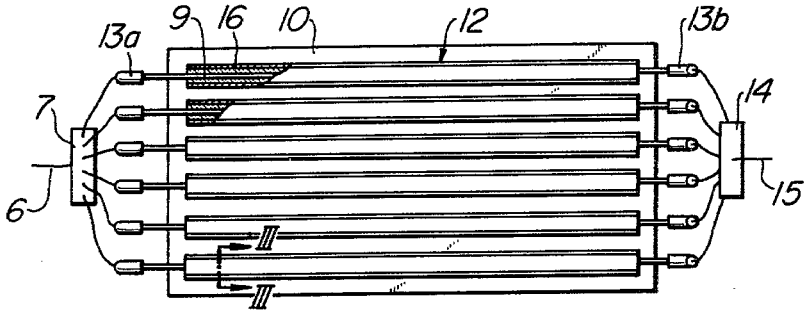
FIG. 2 is a plan view of the apparatus shown in FIG. 1.
Figure 3:
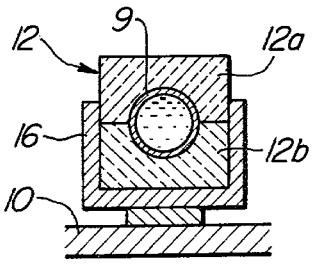
FIG. 3 is a sectional view taken along the line III—III in FIG. 2.

In FIG. 1, there is shown a plating solution storage tank 1 having a monitoring sample 2 inserted therein. The plating solution storage tank 1 is encased in a constant temperature bath 3 for keeping the plating solution in the tank 1 at a predetermined temperature. A liquid (usually water) in the constant temperature bath 3 is circulated by a pump 4 through circulating lines 32 and 33 between the bath 3 and a heater 5 for heating the water in the bath 3. In the embodiment shown, the plating solution is indirectly heated by means of the constant temperature bath 3. However, the invention is not limited to this specific means of heating the plating solution, and direct heating means may alternatively be used for heating the plating solution in the tank 1.

A plating solution supply line 6 formed of polyethylene or tetrafluoroethylene opens at one end thereof in the plating solution storage tank 1 and is connected at the other end thereof to a plating solution distributing box 7. A plating solution circulating pump 8 is mounted in the plating solution supply line 6. A plurality of tubular members 9 of large length (which are, for example, of a zirconium alloy for nuclear fuel cladding) are placed on a tubular member mounting table 10 in such a manner that each tubular member 9 is supported by tube support members 12 formed of foamed polyethylene having the property of keeping warmth. Each support member 12 is hollow and consists of an upper half portion **12*a* and a lower half portion 12*b* each having a semicircular groove which can be separated from each other along the axis of the support member 12. When assembled, the upper half portion 12*a* and the lower half portion 12*b* define therebetween an axial bore formed by the semicircular grooves and having a dimension large enough to enclose therein one of the tubular members to be treated. Each support member 12 is contained in a trough-shaped metal member 16 secured to the mounting table 10 and detachably fastened to the metal member 16** by a band or other suitable known means during operation.

Legs 11 and 11' are attached to opposite end portions of the tube mounting table 10 for supporting the latter. The legs 11 disposed on the plating solution outlet side are capable of adjusting their length so that the tube mounting table 10 can be disposed in a desired inclined position in which the table 10 may be inclined at an angle range of 0–45 degrees. The reason why the tube mounting table 10 is inclined in this manner is because the hydrogen gas produced as a byproduct of a chemical plating can be discharged through the upper ends of the tubular members 9. When the plating solution has a high flow rate, the tubular members 9 may be plated while the mounting table 10 is kept in a horizontal position.

When the mounting table 10 is tilting, the tubular members 9 to be plated can be held in position in the axial bores of the support member 12 by friction produced by the contact of the tubular members 9 with the support members 12, without the tubular members 9 slipping downwardly in the support members 12. Each support member 12 also has the function of keeping warmth so as to minimize fluctuations in the temperature of the plating solution flowing through each tubular member 9.

Figure 5:
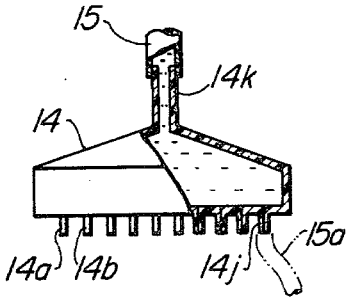
FIG. 5 is a front view of a plating solution collecting member.
Figure 6:
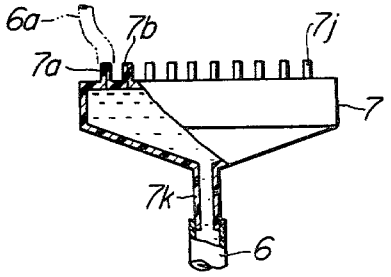
FIG. 6 is a front view of the plating solution distributing member.

A tube end connector 13*a* is fitted at one end thereof over a plating solution inlet end of each of the tubular members 9 and at the other end thereof connected to a plating solution distributing box 7 fixed to a bedplate. The tube end connector 13*a* is held in position by being connected to each tubular member 9. The plating solution distributing box 7 is formed, as shown in FIG. 6, with solution outlets 7*a*, 7*b*, . . . 7*j* which are equal in number to the tubular members 9 so that the plating solution in the box 7 can be simultaneously distributed in equal amounts to all the tubular members 9. A tube end connector 13*b* is fitted at one end thereof over a plating solution outlet end of each of the tubular members 9 and at the other end thereof to one of solution inlets 14*a*, 14*b* . . . 14i j of a plating solution collecting box 14 fixed to another bedplate, as shown in FIG. 5. The plating solution collected in the box 14 is returned to the plating solution storage tank 1 via a plating solution return line 15 consisting of polyethylene or tetrafluoroethylene.

Figure 4:
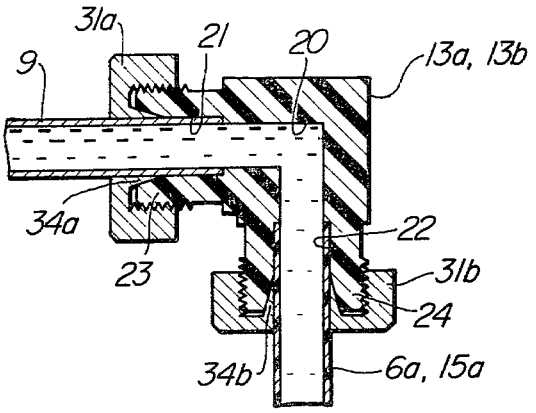
FIG. 4 is a sectional view of a tube end connector, showing the manner in which the tube end connector is fitted over a tubular member to be plated.

FIG. 4 shows the manner in which the tube end connector 13*a* (13*b*) is connected over each tubular member 9 to be plated. The tube end connector 13*a* (13*b*) which is an L-shaped elbow consisted of tetrafluoroethylene (Teflon) is formed with a center axial bore 20 having increased diameter bore portions 21 and 22 at opposite ends thereof so that one end portion of the tubular member 9 and one end portion of a tube 6*a* (15*a*) connected at the other end thereof to the line 6 (15) can adhere closely in the increased diameter bore portions 21 and 22 respectively. End portions 23 and 24 of the tube end connector 13*a* (13*b*) defining the increased diameter bore portions 21 and 22 respectively have tapering inner surfaces extending from their open ends toward the interior of the connector 13*a* (13*b*) to facilitate insertion of the tubular member 9 and the tube 6*a* (15*a*) in the connector 13*a* (13*b*). The end portions 23 and 24 have attached to their outer surfaces tube clamping and fastening members 31*a* and 31*b* respectively. The tube clamping and fastening members 31*a* and 31*b* are formed with projections 34*a* and 34*b* respectively and are in threadable engagement at their inner surfaces with the end portions 23 and 24 at their outer surfaces respectively. Thus, by turning the tube clamping and fastening members 31*a* and 31*b* slightly inwardly, the projections 34*a* and 34*b* can be slightly deformed inwardly to enable the tubular member 9 to be plated and the tube 6*a* (15*a*) to be positively fixed to the inner surfaces of the projections 23 and 24 respectively. At the same time, the projections 34*a* and 34*b* are brought into intimate contact with the tapering inner surface portions of the end portions 23 and 24 respectively, thereby providing a liquid-tight seal satisfactorily.

The plating solution distributing box 7 is in the shape of a letter T and has a hollow interior. The box 7 is formed, as shown in FIG. 6, at its lower end with a plating solution inlet port 7*k* connected to the plating solution supply line 6 and at its upper portion with the plating solution outlets 7*a*, 7*b*, . . . 7*j* each connected to one of the tube 6*a*, with the inlet port 7*a* and the outlets 7*a*, 7*b*, . . . 7*j* being maintained in communication with the hollow interior of the box 7 which is fixed to the bedplate as by a bracket and disposed at a level lower than that of the tube end connectors 13*a*.

The plating solution collecting box 14 is of the same shape as the plating solution distributing box 7 and placed in an inversed position when in operation. More specifically, the plating solution outlets 14*a*, 14*b* . . . 14*j* communicating with the hollow interior of the box 14 are each connected to one of the tube end connectors 13*b* via one of the tubes 15*a*, and a plating solution outlet port 14*k* is connected to the plating solution return line 15. The plating solution collecting box 14 is fixed to another bedplate by a bracket or other known means and disposed at a level higher than that of the tube end connectors 13*b*. The plating solution return line 15 connected to the outlet port 14*k* of the plating solution collecting box 14 includes an inverted U-shape 30 disposed near its connection to the outlet port 14*k* of the box 14.

As described hereinabove in some detail, the plating solution distributing box 7 is disposed at a level lower than that of the tube end connectors 13*a*, the plating solution collecting box 14 is disposed at a level higher than that of the tube end connectors 13*b* and the plating solution return line 15 is formed with the inverted U-shape 30. By these structural features, the same head pressure H can be applied to all the tubular members 9 and the plating solution can be made to a uniform flow rate through all the tubular members 9. As a result, it is possible to obtain substantially the same thickness in the coating applied to the inner surfaces of the tubular members 9 treated at the same time, thereby, obviating the disadvantage of variations in quality caused in the prior art.

In the constructional form of the invention described hereinabove, the plating solution heated to a predetermined temperature in the plating solution storage tank 1 is supplied to the plating solution distributing box 7 via the plating solution supply line 6 by the plating solution circulating pump 8. The plating solution supplied to the distributing box 7 is simultaneously distributed to the plurality of tubular members 9 arranged on the tubular member mounting table 10. The plating solution released from the tubular members 9 is collected in the plating solution collecting box 14 and returned to the tank 1 via the plating solution return line 15. The thickness of the coating applied to the inner surfaces of the tubular members 9 is controlled by means of the monitoring sample 2 inserted in the tank 1. The plating operation is completed when the monitoring sample 2 indicates the predetermined thickness.

The effects achieved by the invention will be summarized hereinafter.

(1) The arrangement that a plurality of tubular members 9 to be plated are treated at one time while being placed on a single table, enables the inner surfaces of a large number of tubular members to be plated in a short period of time.

(2) The arrangement that a single plating solution supply line 6 having connected thereto a plating solution circulating pump 8 is used for supplying a plating solution to a plurality of tubular members to be plated, enables a plating operation to be carried out more economically and permits a pump cleaning operation to be performed more readily than when the pumps used are equal in number to the tubular members to be plated.

(3) The arrangement that a plating solution discharged from the plurality of tubular members 9 is collected in a plating solution collecting box 14, enables the same head pressure to be given to the plating solution flowing through all the tubular members 9. Thus, the plating solution flowing through all the tubular members 9 can be rendered uniform in flow rate, thereby making it possible to obtain coating applied to the inner surface of the tubular members which has same in thickness, color and smoothness.

EXAMPLE 1

By using the apparatus according to the invention, copper plating was applied simultaneously to ten (10) zircaloy-2 tubes for enclosing nuclear fuel and having an inner diameter of 10.8 mm, a thickness of 0.86 mm and a length of 4000 mm. The results are shown in Table 2. The composition of a chemical copper plating solution used and the plating conditions are shown in Table 1.

TABLE 1

| Plating Conditions | | Composition of Chemical Copper Plating Solution | |
|---|---|---|---|
| Item | Conditions | | |
| Liquid Temperature | 50–55° C. | Copper Sulfate Crystal | 0.03 M/l |
| Flow Velocity | 0.2 m/sec | EDTA | 0.04 M/l |
| Thickness of Plating | 5 ± 0.5μ | NaOH | 0.23 M/l |
| Angle of Inclination of Tubes | 10° | HCHO | 0.1 M/l |

TABLE 2

| Tube No. | Thickness of Copper Plating (μ) A (Inlet Side) | B (Intermediate Portion) | C (Outlet Side) |
|---|---|---|---|
| 1 | 4.7 | 4.8 | 4.8 |
| 2 | 4.8 | 4.8 | 4.8 |
| 3 | 4.8 | 4.9 | 4.9 |
| 4 | 4.7 | 4.9 | 4.8 |
| 5 | 5.0 | 5.0 | 4.9 |
| 6 | 5.0 | 4.8 | 4.7 |
| 7 | 4.7 | 4.9 | 4.7 |
| 8 | 5.0 | 5.0 | 4.8 |
| 9 | 4.8 | 4.9 | 5.0 |
| 10 | 4.9 | 5.0 | 4.7 |

As can be seen in Table 2, the plating applied to the ten tubes for nuclear fuel had a little variation in thickness and had substantially the same color and smoothness.

From the foregoing description, it will be appreciated that the apparatus according to the invention is capable of efficiently applying chemical plating to the inner surfaces of a large number of tubular members with very little variation in the quality of the coating applied to all the tubular members and yet allows easy maintenance and inspection.

What is claimed is:

1. Apparatus for applying chemical plating to surfaces of tubular members, comprising:

a tank for storing a plating solution;

a mounting table for supporting a plurality of tubular members to be simultaneously plated;

a plurality of first tube end connectors each detachably fitted over a plating solution inlet end of each of said tubular members to be plated and a plurality of second tube end connectors each detachably fitted over a plating solution outlet end of each of said tubular members to be plated;

a plating solution distributing member connected to all said first tube end connectors;

a plating solution collecting member connected to all said second tube end connectors;

a first line connecting said plating solution storage tank to said plating solution distributing member;

a pump mounted in said first line; and a second line connecting said plating solution collecting member to said plating solution storage tank and having an inverted U-shape in the vicinity of the connection between said second line and said collecting member.

2. Apparatus as claimed in claim 1, wherein said mounting table comprises hollow support means for receiving therein said plurality of tubular members, each of said support means being constituted by two elements separable along the longitudinal axis of said support means.

3. Apparatus as claimed in claim 2, wherein each of said hollow support means is made of a heat insulating material.

4. Apparatus as claimed in any one of claims 1, 2 or 3, further comprising means for keeping the plating solution in said plating solution tank at a predetermined temperature.

5. Apparatus as claimed in claim 4, further comprising a monitor sample arranged in said plating solution tank for indicating the thickness of coating applied to the inner surfaces of the tubular members to be plated.

6. Apparatus as claimed in claim 5, including a plurality of first tube means each connecting said plating solution distributing member to a first tube end connector and a plurality of second tube means each connecting said plating solution collecting member to a second tube connector, and wherein said first and second tube end connectors each have at opposite ends thereof bore portions brought into liquid-tight engagement with an end portion of one of said tubular members to be plated and an end portion of said first and second tube means.

7. Apparatus as claimed in claim 6, wherein said plating solution distributing member is in the shape of a letter T and formed at its upper position with a plurality of plating solution outlets and at its underposition with a single plating solution inlet, said outlets and said inlet connecting with a hollow portion formed in the interior of said distributing member.

8. Apparatus as claimed in claim 6, wherein said plating solution collecting member is in the form of an inversed shape T and formed at its upper surface with a single plating solution outlet and at its underposition with a plurality of plating solution inlets, said outlet and said inlet connecting with a hollow portion formed in the interior of said collecting member.

9. Apparatus as claimed in claim 6, further including tube clamping members on the ends of said first and second tube end connectors for securing an end portion of the tubular members to be plated and an end portion of said first and second tube means in liquid-tight engagement with the first and second tube end connectors.

10. Apparatus as claimed in claim 1, wherein said plating solution collecting member is disposed at a higher position than the outlet end of each of said plurality of tubular members to be plated.

11. Apparatus as claimed in claim 1, wherein said mounting table is positioned such that it makes an angle of 0°–45° with the horizontal.

12. Apparatus as claimed in claim 11, wherein said mounting table is inclined up to an angle of 45°, whereby said tubular members are inclined, with said first tube end connectors fitted to the lower end of each inclined tubular member and said second tube end connectors being fitted to the upper end of each inclined tubular member.

13. Apparatus as claimed in claim 1, wherein said plating solution distributing member is placed at a level below that of the first tube end connectors and said plating solution collecting member is placed at a level above that of the second tube end connectors.

* * * * *